United States Patent [19]

Barnes, Jr.

[11] Patent Number: 4,699,641

[45] Date of Patent: Oct. 13, 1987

[54] SUPPORT TRAY FOR DISPOSABLE FILTER BAG

[75] Inventor: James F. Barnes, Jr., Anderson, S.C.

[73] Assignee: The Singer Company, Stamford, Conn.

[21] Appl. No.: 912,740

[22] Filed: Sep. 29, 1986

[51] Int. Cl.[4] ..... B01D 46/00

[52] U.S. Cl. ..... 55/480; 55/373; 55/374; 55/467; 15/352

[58] Field of Search ..... 55/356, 357, 369, 370, 55/373, 374–378, 481, 480, 467, 472, 490; 15/327 F:347, 352

[56] References Cited

U.S. PATENT DOCUMENTS

| | | | |
|---|---|---|---|
| 2,930,446 | 3/1960 | Momberg et al. | 55/356 |
| 3,614,860 | 10/1971 | Grellson | 55/357 |
| 3,636,681 | 1/1972 | Batson et al. | 55/472 |
| 3,675,399 | 7/1972 | Westergren | 55/357 |
| 3,812,659 | 5/1974 | Westergren | 55/375 |
| 4,257,789 | 3/1981 | Leinfelt | 55/378 |
| 4,586,214 | 5/1986 | Berifield | 15/327 F |

*Primary Examiner*—Bernard Nozick
*Attorney, Agent, or Firm*—David L. Davis

[57] ABSTRACT

A disposable filter bag accommodating tray insertable through an opening in a vacuum cleaner includes a front wall closing the cleaner opening and features absence of a tray rear wall permitting rearrangement of bag shape during tray withdrawl to minimize bag rupture and easy bag disposal by simply inverting the tray.

4 Claims, 4 Drawing Figures

Fig. 1.
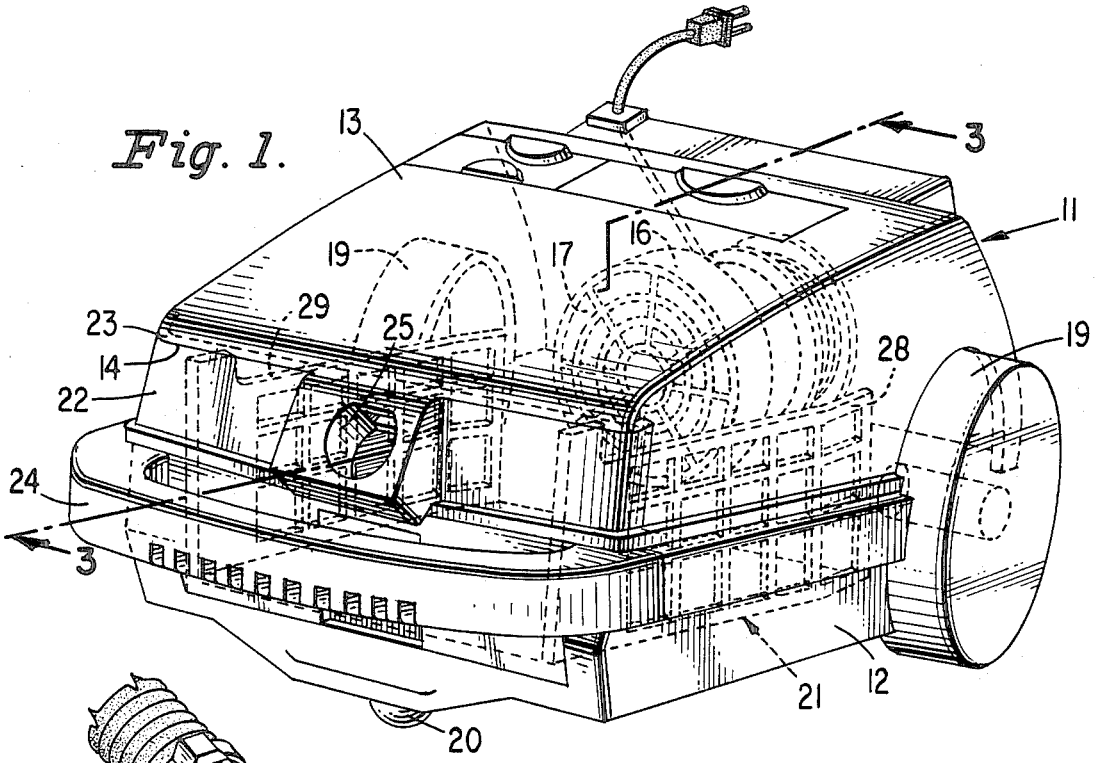
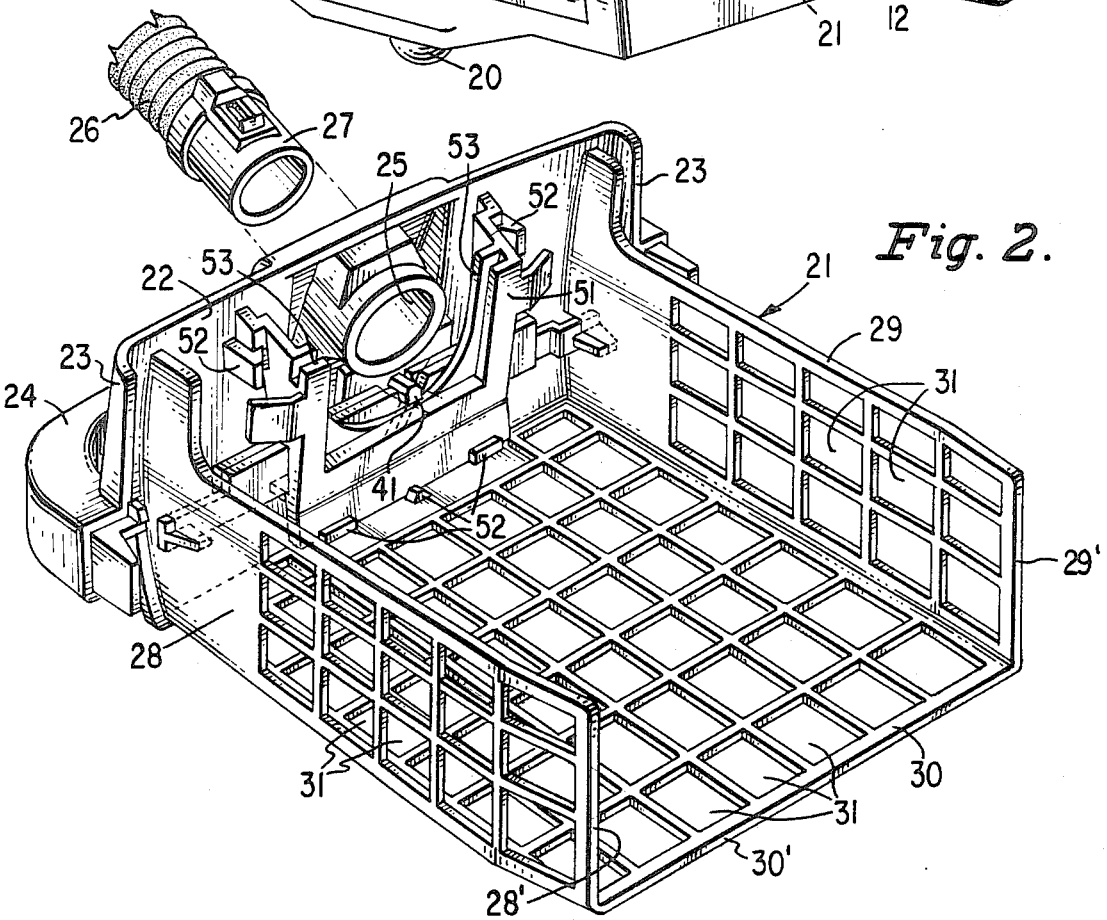
Fig. 2.

Fig. 3.
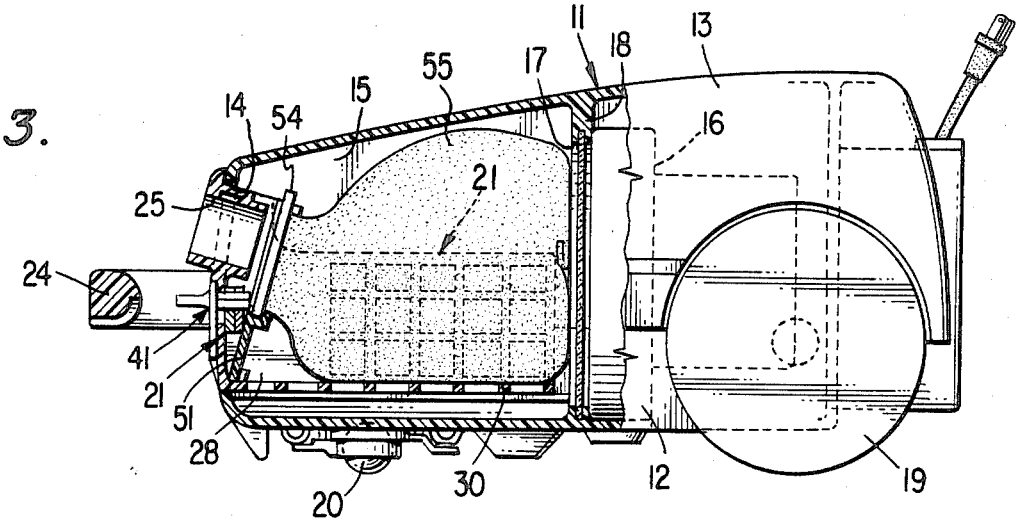
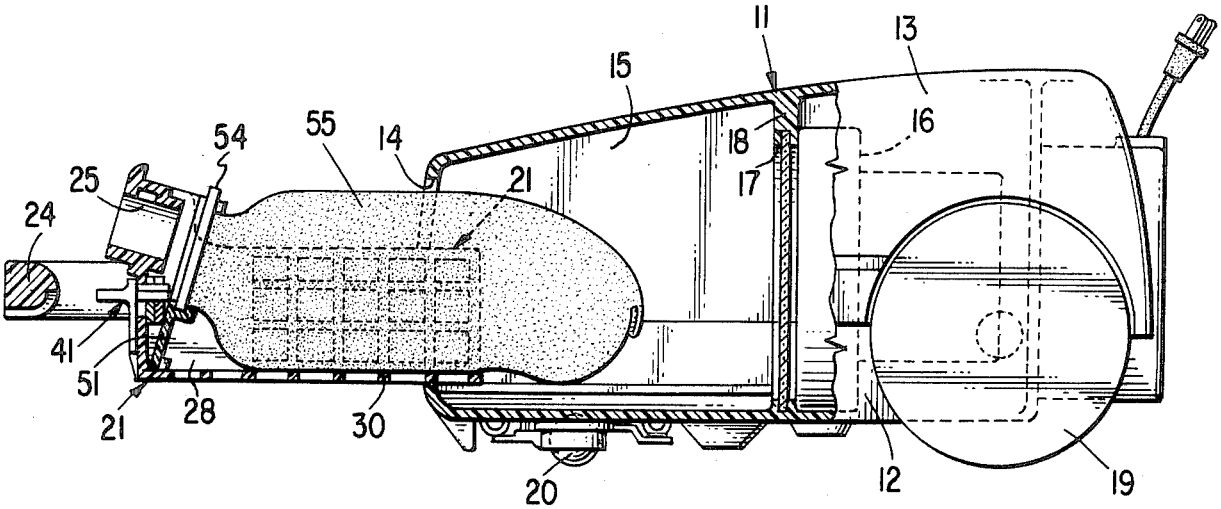
Fig. 4.

SUPPORT TRAY FOR DISPOSABLE FILTER BAG

BACKGROUND OF THE INVENTION

1. Field of the Invention

This invention relates to vacuum cleaners of the type employing a disposable filter bag and, more particularly, to a novel carrier device for supporting a filter bag in predetermined operative position within a vacuum cleaner.

2. Description of the Prior Art

Conventional vacuum cleaners which include provision for use of a disposable filter bag require that the filter bag must be handled and carried apart from any tray or carrier to a disposal facility. U.S. Pats. Nos. 3,675,399, July 11, 1972 and 4,257,789, Mar. 24, 1981, disclose vacuum cleaner constructions in which filter bag disposal in this conventional fashion is required. Dust and debris separating or collecting pans or trays, per se, are known in the vacuum cleaner art as shown in U.S. Pat. Nos. 1,098,507, June 2, 1914 and 3,856,488, Dec. 24, 1974, but spilling of the collected dirt is possible because the combination with a disposable filter bag is not included.

OBJECTS OF THE INVENTION

It is an object of this invention to provide a support tray construction which facilitates conveyance of a filled filter bag to a disposal facility with minimized risk of filter bag rupture or accidental dirt spillage. Another object of this invention is to provide simple and effective means for releasiing a filled filter bag into a disposal facility.

SUMMARY OF THE INVENTION

These objects of the invention are attained by a tray which is insertable like a drawer through an access aperture in a vacuum cleaner housing into a dirt collecting chamber within the cleaner. Inside the front wall of the tray, a socket is provided into which the rigid flanges about the mouth of a conventional disposable filter bag may be lowered to locate and secure a disposable filter bag on the tray. Engagement of the filter bag mouth in the socket retains the bag securely on the tray while the tray is kept upright so that the filled bag may be carried to a disposal facility in the tray without danger of spilling. At the disposal facility, the filled bag may be deposited therein by simply inverting the tray.

The side and bottom walls of the tray, which are latticed so as not to impede flow of air from the filter bag supported in the tray, extend into the filter bag accommodating cavity in the vacuum cleaner; and a back wall is purposely omitted from the tray so that unimpeded attenuation and rearrangement of the shape of a filled filter bag is accommodated during removal of the tray from the vacuum cleaner to alleviate abrasion of a filled bag against the access opening in the vacuum cleaner thus to minimize the risk of bag rupture and dirt spillage during bag removal.

DESCRIPTION OF THE DRAWINGS

With the above and additional objects and advantages in view, as will hereinafter appear, this invention will now be described with reference to the accompanying drawings of a preferred embodiment in which:

FIG. 1 is a perspective view of a vacuum cleaner haviing a disposable filter bag support tray inserted therein;

FIG. 2 is a perspective view of the filter bag support tray separated from the vacuum cleaner and shown with a fragment of the hose connector;

FIG. 3 is a cross sectional view taken substantially along line 3—3 of FIG. 1 showing the filter bag support tray fully inserted in the vacuum cleaner and illustrating a disposable filter bag which is substantially full of collected debris and is sustained in place on the tray; and FIG. 4 is a cross sectional view similar to that of FIG. 3, but showing the filter bag support tray during withdrawal from the vacuum cleaner.

Illustrated in FIGS. 1, 3 and 4 is a canister type vacuum cleaner indicated generally at 11 to which the filter bag supporting tray of this invention is applied; although, as will be apparent from the following description, this invention is not limited to use with canister type vacuum cleaners.

The cleaner shown in the accompanying drawings includes a housing having a base portion 12 and a cover portion 13 together formed with a generally rectangular opening 14 into an internal compartment 15. Also within the housing 12, 13, is a motor blower unit 16 having an air inlet 17 through an internal partition 18 formed jointly in the base 12 and cover 13 portions of the cleaner housing so as to define the rear wall of the compartment 15.

The cleaner housing is floor supported on a set of wheels 19—19 adjacent the motor blower unit and a spherical roller 20 constrained on the housing base 12 beneath the compartment 15. In operation, the motor blower unit 16 drawing air through the inlet 17 and exhausting the air through exhaust ports (not shown) in the housing creates a vacuum in the housing compartment 15 to be used for dirt and debris collection.

The filter bag supporting tray, indicated generally at 21 which is illustrated separate from the cleaner in FIG. 2 and fully inserted in place in the cleaner housing 12, 13 in FIG. 1, includes a front wall 22 complemental in size and shape to the rectangular opening 14 in the vacuum cleaner housing. The front wall 22 of the tray may also be formed with peripheral extensions 23 to envelope the cleaner housing when the tray is inserted therein and improve the airtight nature of the closure provided by the tray front wall. A handle 24 may also be formed transversely across the tray front wall and, centrally of the front wall 22, a hose connection port 25 is formed. Any conventional flexible hose 26 leading to interchangeable cleaning nozzles with a latching extremity 27 mating with the connection port 25 may be used with the tray of this invention and thus only a fragment is illustrated in FIG. 2.

Extending from the tray front wall 22 are sidewalls 28 and 29 and a bottom wall 30 each of which is formed with a latticed array of apertures 31 to provide for air flow therethrough. Each of the sidewalls 28 and 29 and the bottom wall 30 terminates in a free extremity 28', 29' and 30', respectively, since the tray is formed without a back wall.

Any known type of latch device may be employed to retain the tray 21 in place in the vacuum cleaner body. Indicated generally at 41 is a preferable latch device which is described in detail in copending U.S. patent application of Louis A. Rotola, Jr. and Gordon E. Laing, Ser. No. 912,741 filed Sept. 29, 1986, to which reference may be had for a more complete disclosure of the latch.

Inside the front wall 22 of the tray a bracket 51 is located being positioned and secured in place by a plurality of retaining lugs 52 extending from the front wall 22 and bottom wall 30 of the tray. The bracket 51 is formed with an upwardly open slot 53 which slidably accommodates the cardboard or plastic mounting plate 54 attached to the mouth of a conventional disposable paper filter bag 55.

As is conventional in the art, the mounting plate 54 may be formed with a displaceable valve (not shown) of rubber or the like which is located such that, when the mounting plate is positioned in the slot 53 of the bracket 51, insertion of a hose extremity 27 through the connection port will shift the valve aside and establish communication of the hose 26 to the interior of the disposable filter bag 55.

Referring now to FIGS. 3 and 4, the manner of operation and advantages of the support tray for disposable filter bag of this invention will be described.

With a disposable filter bag inserted in place on the tray 21 by positioning of a filter bag mounting plate 54 into the bracket slot 53 and insertion of the tray into the vacuum cleaner compartment 15, operation of the motor blower unit 16 creates a vacuum in the compartment 15 and draws air through the filter bag 55, through the connection port 25, and through a hose connected thereto so as to draw air through the system and capture dirt and debris extrained therein in the filter bag 55.

As shown in FIG. 3, the filter bag may, if used sufficiently, expand due to the accummulation of dirt and debris until the girth of the filter bag exceeds the size of the vacuum cleaner opening 14. A danger then arises that, in withdrawing the filled bag, contact of the bag with the opening 14 may rupture the bag and spill the collected dirt and debris.

As shown in FIG. 4, this danger of filter bag rupture during withdrawal from the cleaner is obviated in the present invention because the absence of a rear wall on the tray provides for rearrangement of the filter bag shape during tray withdrawal.

So long as the tray 21 is maintained upright, however, the filter bag will remain supported by the tray because of the engagement of the filter bag mounting plate 54 in the bracket slot 53 in the tray. The filled bag can thus be safely transported to a disposal point and deposited therein by simply inverting the tray whereupon the filter bag mounting plate will slide out of the bracket slot and the tray will be readied to accommodate a fresh filter bag.

Accordingly, there has been disclosed an improved support tray for a vacuum cleaner filter bag. It is understood that the above-described embodiment is merely illustrative of the application of the principles of this invention. Numerous other arrangements may be devised by those skilled in the art without departing from the spirit and scope of this invention, as defined by the appended claims.

What is claimed is:

1. In a vacuum cleaner having a housing enclosing a dirt collecting compartment, and a motor blower unit associated with said housing for producing a vacuum therein, said housing being formed with an access opening communicating with said compartment the improvement comprising, a tray insertable into said compartment through said access opening, including:

a front wall complemental in size and shape to that of said access opening, said front wall including means defining an inlet opening into said compartment for accommodating a dirt collecting nozzle, sidewalls and a bottom wall each joined at one extremity to said tray front wall and each extending from said front wall to a free extremity, and retaining means on said tray for sustaining a disposable dirt collecting bag on said bottom wall and between said sidewalls in operative registration with said inlet opening whereby modification of the shape of a filled dirt collecting bag sustained on said tray by said retaining means is unimpeded during withdrawal of said tray through said compartment access opening.

2. In the vacuum cleaner as set forth in claim 1 the improvement in which said sidewalls and bottom wall of said tray are latticed to maximize air flow from a dirt collecting bag sustained on said tray.

3. In the vacuum cleaner as set forth in claim 1 the improvement in which said dirt collecting bag retaining means is arranged inside said front wall.

4. In the vacuum cleaner as set forth in claim 3 the improvement in which a latch means is provided on said tray for retaining said front wall in place closing said compartment access opening, and in which a handle and a latch release means are provided on said front wall exterior beneath said inlet opening.

* * * * *